US012686998B2

(12) United States Patent
Xie et al.

(10) Patent No.: US 12,686,998 B2
(45) Date of Patent: Jul. 21, 2026

(54) AUTOMATIC REMOTE WATER SUPPLY SYSTEM IN LOW GRAVITY ENVIRONMENT

(71) Applicant: Chongqing University, Chongqing (CN)

(72) Inventors: Gengxin Xie, Chongqing (CN); Xi Wang, Chongqing (CN); Xiaojun Yang, Chongqing (CN); Dan Qiu, Chongqing (CN); Pan Dong, Chongqing (CN); Xianzhe Zheng, Chongqing (CN); Yingbo Liu, Chongqing (CN); Jinghang Ding, Chongqing (CN)

(73) Assignee: Chongqing University, Chongqing (CN)

( * ) Notice: Subject to any disclaimer, the term of this patent is extended or adjusted under 35 U.S.C. 154(b) by 47 days.

(21) Appl. No.: 18/587,086

(22) Filed: Feb. 26, 2024

(65) Prior Publication Data

US 2024/0328128 A1 Oct. 3, 2024

(30) Foreign Application Priority Data

Mar. 28, 2023 (CN) ..... 202310318365.8

(51) Int. Cl.
*E03B 1/04* (2006.01)
*E03B 5/00* (2006.01)

(52) U.S. Cl.
CPC . *E03B 1/04* (2013.01); *E03B 5/00* (2013.01)

(58) Field of Classification Search
CPC ..... E03B 1/04; E03B 5/00
(Continued)

(56) References Cited

U.S. PATENT DOCUMENTS 3,935,882 A 2/1976 Matthews
11,773,998 B2 * 10/2023 Zhuravlev ..... F16K 17/40 137/74

(Continued)

FOREIGN PATENT DOCUMENTS

CN 2354894 Y 12/1999
CN 101810127 A 8/2010

(Continued)

OTHER PUBLICATIONS

First Office Action issued in counterpart Chinese Patent Application No. 202310318365.8, dated Apr. 3, 2024.

(Continued)

*Primary Examiner* — Angelisa L. Hicks
(74) *Attorney, Agent, or Firm* — Westbridge IP LLC

(57) ABSTRACT

Disclosed are an automatic remote water supply system in a low gravity environment, which includes a water supply unit, an environment detection unit and a control unit. The water supply unit includes a water bag, an air inlet pipe, a water pipe and a water pump on the water pipe. The bottom of the water bag has an air inlet and a water outlet. The air inlet pipe is communicated with the water bag through the air inlet. The water pipe is communicated with the water bag through the water outlet. The environment detection unit is configured to detect environmental information in the ecosystem to which the water supply system belongs in the low gravity environment. The control unit is configured to control the starting state of the water pump according to the environmental information, so that water in the water bag flows out through the water pipe.

7 Claims, 6 Drawing Sheets

(58) Field of Classification Search
USPC ..... 137/468
See application file for complete search history.

(56) References Cited

U.S. PATENT DOCUMENTS

| | | | | |
|---|---|---|---|---|
| 2002/0017055 | A1* | 2/2002 | Nalbandian | A01G 27/006 47/48.5 |
| 2012/0279120 | A1* | 11/2012 | Prescott | A01G 25/06 47/48.5 |
| 2020/0390046 | A1 | 12/2020 | Weislogel et al. | |

FOREIGN PATENT DOCUMENTS

| | | | | | |
|---|---|---|---|---|---|
| CN | 102849309 | A | | 1/2013 | |
| CN | 206782357 | U | | 12/2017 | |
| CN | 111084158 | A | * | 5/2020 | A01K 67/68 |
| CN | 112620647 | A | | 4/2021 | |
| FR | 2859625 | A1 | * | 3/2005 | A61J 1/2093 |
| KR | 20190093349 | A | | 8/2019 | |
| WO | 2005025482 | A1 | | 3/2005 | |

OTHER PUBLICATIONS

Notification to Grant Patent Right for Invention issued in counterpart Chinese Patent Application No. 202310318365.8, dated Apr. 15, 2024.

* cited by examiner

AUTOMATIC REMOTE WATER SUPPLY SYSTEM IN LOW GRAVITY ENVIRONMENT

CROSS-REFERENCE TO RELATED APPLICATIONS

The present application claims priority to Chinese Patent Application No. 202310318365.8, filed on Mar. 29, 2023, the entire contents of which are incorporated herein by reference.

TECHNICAL FIELD

The present application relates to the technical field of water supply, and in particular to an automatic remote water supply system in a low gravity environment.

BACKGROUND

An automatic water supply system is a device installed in a micro-ecosphere in a low-gravity environment to supply water to organisms or especially plants in the biosphere under preset conditions, playing an important role in maintaining the stability and balance of the micro-ecosphere in a low-gravity environment.

At present, some of the existing plant watering or water supply devices use soil moisture as the starting signal for watering, and some use time as the starting signal to perform regular watering. However, these starting signals are difficult to meet the requirements of observing the entire physiological cycle of organisms in the micro-ecosystem, resulting in existing water supply devices or systems having single functions, insufficient intelligence, and inadequate applicability to low gravity environments. Therefore, there is a need for an automatic remote water supply system in a low gravity environment that can solve the above problems.

SUMMARY

In view of this, the purpose of the present application is to overcome the shortcomings of the related art and provide an automatic remote water supply system in a low gravity environment, which can provide dynamic real-time water supply according to the actual working conditions of the low gravity environment and is highly intelligent.

The automatic remote water supply system in the low gravity environment according to present application includes a water supply unit, an environmental detection unit and a control unit.

The water supply unit includes a water bag, an air inlet pipe, a water pipe and a water pump provided on the water pipe, the water bag is provided with an air inlet and a water outlet at a bottom, the air inlet pipe is communicated with the water bag through the air inlet, and the water pipe is communicated with the water bag through the water outlet.

The environmental detection unit is configured to detect environmental information in an ecological circle to which the water supply system belongs in the low gravity environment.

The control unit is configured to control a starting state of the water pump according to the environmental information, so that water in the water bag flows out through the water pipe.

In an embodiment, a first blocking medium is provided in a pipeline of the air inlet pipe, the first blocking medium is configured to separate an air inlet from an air outlet of the air inlet pipe, and the first blocking medium is driven to move inside the air inlet pipe; a second blocking medium is provided in a pipeline of the water pipe, the second blocking medium is configured to separate an inlet water from the water outlet of the water pipe, and the second blocking medium is driven to move inside the water pipe.

In an embodiment, both the first blocking medium and the second blocking medium determine a length of the blocking medium according to the following method:

S1, building an environmental condition: applying 10 times the weight of water $m_{water}$ to the water bag in a vertical direction, and adjusting an environmental temperature of the water supply unit to a preset maximum temperature in the low gravity environment, where $m_{water}$ is the mass of water in the water bag;

S2, filling the air inlet pipe and water pipe with the blocking medium of a length 1, respectively, letting the pipeline stand for 48 hours, and proceeding to the next step; and S3, determining whether water is squeezed out of the water bag, in response to that water is squeezed out of the water bag, returning to step S2, and in response to that water is not squeezed out of the water bag, configuring a length of the medium after the blocking medium is gradually filled in the air inlet pipe or water pipe as the length of the blocking medium.

In an embodiment, the first blocking medium or the second blocking medium is filled according to the following method:

placing the blocking medium in a container with good thermal conductivity and placing the container on a hot water surface; after the blocking medium is melted into a liquid state, using a syringe to extract a liquid blocking medium and injecting the liquid blocking medium into the air inlet pipe or water pipe; then letting the liquid blocking medium stand and wait for the blocking medium to slowly cool down, and a temperature of hot water is higher than a melting point of the blocking medium.

In an embodiment, both the first blocking medium and the second blocking medium are made of lipid-like chemicals.

In an embodiment, the water pump is provided on the water pipe close to the water outlet.

In an embodiment, the environmental information includes temperature and illumination.

In an embodiment, the water pump is an electromagnetic water pump.

In an embodiment, controlling the starting state of the water pump according to the environmental information so that water in the water bag flows out through the water pipe includes:

a, determining whether the temperature is greater than or equal to a preset temperature and whether the illumination is greater than or equal to a preset illumination, in response to that the temperature is greater than or equal to the preset temperature and the illumination is greater than or equal to the preset illumination, starting the water pump and proceeding the next step, and in response to that the temperature is less than the preset temperature and the illumination is less than the preset illumination, not starting the water pump; and b, determining whether a water pressure on an outlet side of the water pump is less than a preset pressure, in response to that the water pressure on the outlet side of the water pump is less than the preset pressure, the water pump is configured to stop working, and in response to that the water pressure on the outlet side of the water pump is greater than or equal to the preset pressure, the water pump is configured to work continuously and extract water in the water bag, so that the water flows out from the water outlet of the water pipe.

In an embodiment, the water supply unit further includes a plastic slot for fixing the water bag, a base for fixing the water pump and tie lines spaced around the water pipe.

The automatic remote water supply system in the low gravity environment according to the present application automatically turns on the water pump based on the temperature and illumination in the closed space, appropriately selects watering conditions, accurately grasps the watering time, and has strong functionality, high level of intelligence, convenience and fast. At the same time, it can adapt to the overweight period of rocket launch, the weightless period of the transfer of celestial bodies or man-made spacecraft from the earth to the low gravity environment, and can adapt well to the low gravity environment, realizing automatic watering of the micro ecosphere in the low gravity environment.

BRIEF DESCRIPTION OF THE DRAWINGS

The present application will be further described below in conjunction with the accompanying drawings and embodiments.

DETAILED DESCRIPTION OF THE EMBODIMENTS

Figure 1:
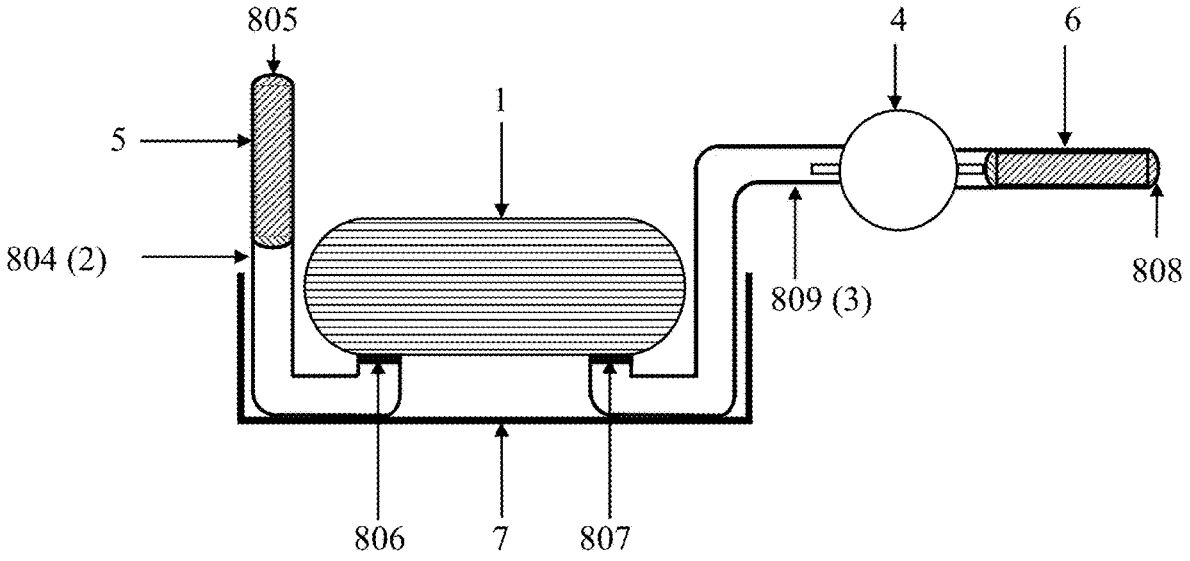
FIG. 1 is a schematic structural diagram of a system according to the present application.

The present application will be further described below in conjunction with the accompanying drawings, as shown in the figures.

The automatic remote water supply system in a low gravity environment of the present application includes a water supply unit, an environment detection unit 802 and a control unit. The low gravity environment is an environment lower than the gravity environment of the earth, for example, the moon's gravity environment is the low gravity environment.

The water supply unit includes a water bag 1, an air inlet pipe 2, a water pipe 3 and a water pump 4 on the water pipe 3. The bottom of the water bag 1 has an air inlet 805 and a water outlet, the air inlet pipe 2 is communicated with the water bag 1 through the air inlet 805, and the water pipe 3 is communicated with the water bag 1 through the water outlet.

By providing the water outlet at the bottom of the water bag 1, the water in the water bag 1 can be drained cleanly, maximizing the utilization of water resources. By providing the air inlet 805 at the bottom of the water bag 1, when the sum of the water pressure at the bottom of the water bag 1 and the air pressure inside the water bag 1 is less than the air pressure outside the water bag 1, air can enter the water bag 1 through the air inlet pipe 2 and rise to the water surface in the form of bubbles from the bottom. By indirectly pressurizing the water inside the water bag 1 through the air pressure outside the water bag 1, it is possible to ensure that the water pressure at the water outlet through which the water pipe 3 is communicated with the water bag 1 decreases relatively smoothly, so that the water flow pumped out by the water pump 4 is smooth and stable, the water pressure is not too high and the water head is not too high, to prevent water from spilling to other places outside the soil, and to avoid spattering on equipment near the water bag.

Figure 5:
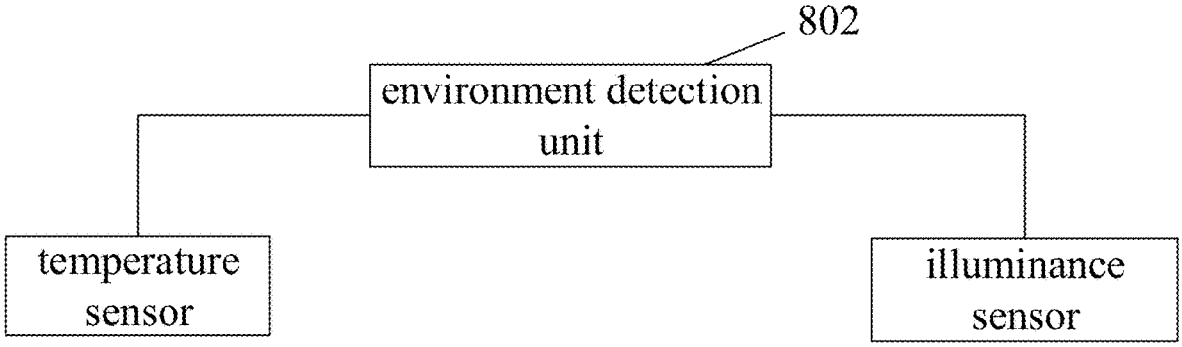
FIG. 5 is a module schematic diagram of an environment detection unit according to the present application.

Referring to FIG. 5, the environment detection unit 802 is configured to detect environmental information in the ecological circle 801 to which the water supply system belongs in the low gravity environment. The environmental information includes temperature and illumination. A temperature sensor can be used to measure the temperature and an illumination sensor can be used to measure the illumination, and the temperature sensor and the illumination sensor adopt the related art, which will not be described again.

Figure 6:
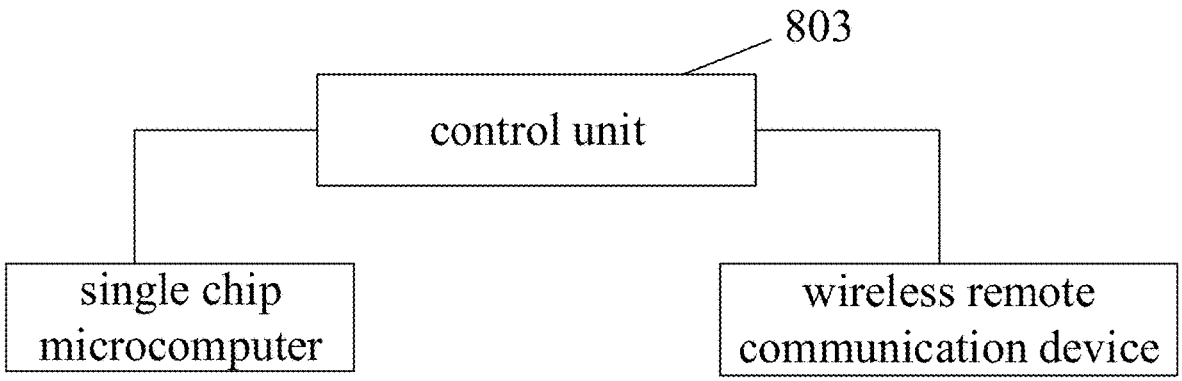
FIG. 6 is a module schematic diagram of a control unit according to the present application.

Referring to FIG. 6, the control unit 803 is configured to control a starting state of the water pump 4 according to the environmental information, so that the water in the water bag 1 flows out through the water pipe 3. The control unit 803 includes an existing controller or an existing single chip microcomputer. In order to achieve remote communication, the control unit 803 also includes an existing wireless remote communication device, which will not be described again here.

Figure 7:
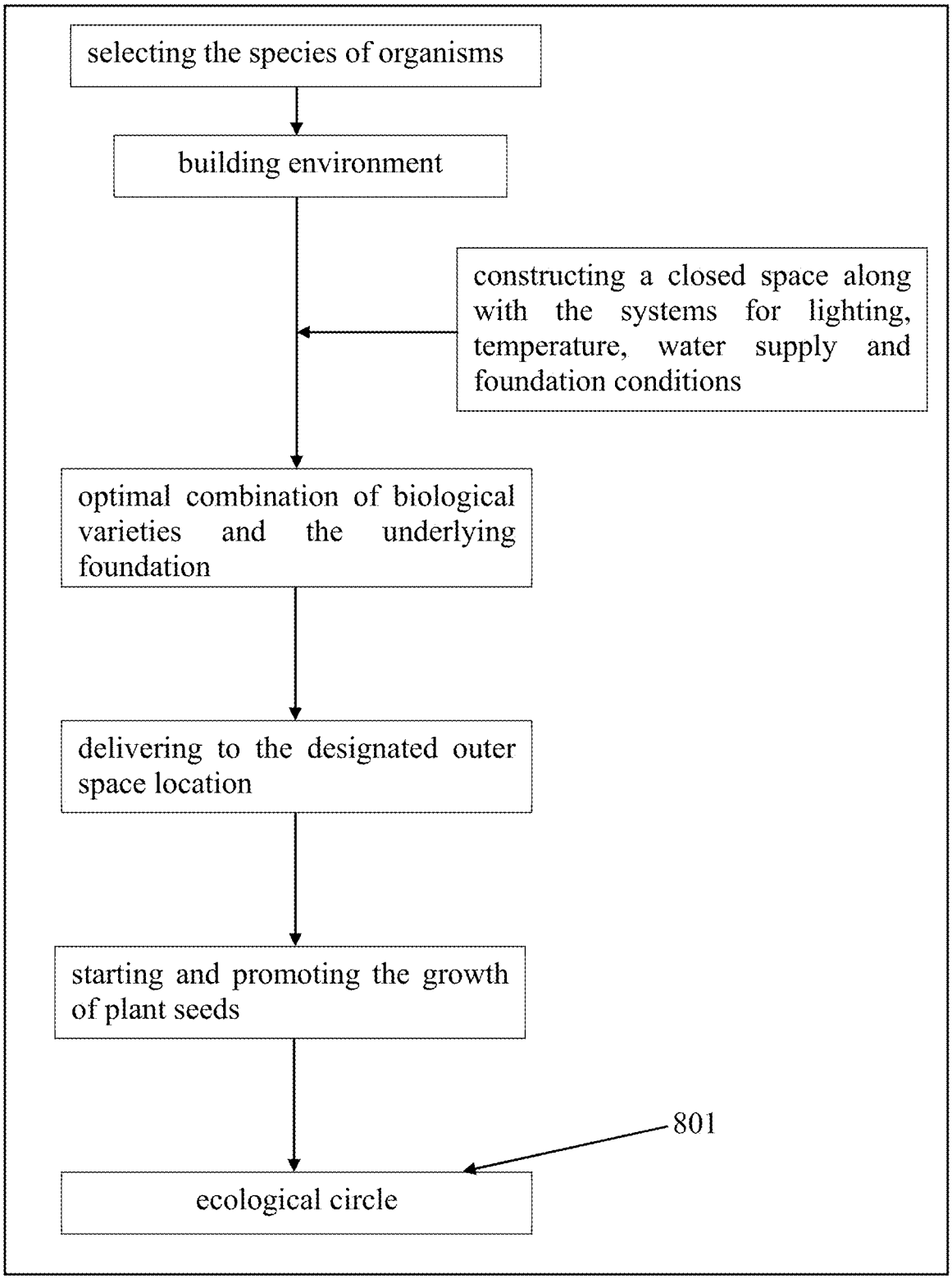
FIG. 7 (Prior Art)
FIG. 7 is a schematic diagram of a formation process of an ecological circle according to the present application.

Referring to FIG. 7, the ecological circle 801 is formed according to the following method:

- selecting the species of organisms;
- building environment;
- constructing a closed space along with the systems for lighting, temperature, water supply and foundation conditions;
- optimal combination of biological varieties and the underlying foundation;
- delivering to the designated outer space location;
- starting and promoting the growth of plant seeds; and
- forming the ecological circle 801.

In this embodiment, a first blocking medium 5 is provided in the pipe of the air inlet pipe 2, and the first blocking medium 5 separates the air inlet end and the air outlet 806 end (in the preparation stage, when the water is injected into the water bag, it is the air outlet 806 end.) of the air inlet pipe 2. The first blocking medium 5 can be driven to move within the air inlet pipe 2. A second blocking medium 6 is provided in the pipe of the water pipe 3, and the second blocking medium 6 separates the water inlet 807 end (in the preparation stage, when the water is injected into the water bag, it is the water inlet 807 end.) and the water outlet 808 end of the water pipe 3. The second blocking medium 6 can be driven to move within the water pipe 3.

Through the above structure, the problem is solved that when the automatic remote water supply system is launched with the lunar lander, the overweight acceleration generated in the overweight state squeezes the water in the water bag 1 through the water pipe 3 and the air inlet pipe 2, thereby ensuring the water in the water bag 1 can be delivered intact to the low gravity environment.

It should be noted that, as shown in FIG. 1, in order to ensure that the water will not flow out from the air inlet pipe 2 when flowing out of the water pipe 3, the horizontal height at the air inlet end of the air inlet pipe 2 is greater than or equal to the horizontal height at the water outlet 808 end of the water pipe 3.

In this embodiment, before the automatic remote water supply system is sent to a low-gravity environment, a blocking length of the blocking medium is determined in advance, and the air inlet pipe 2 or the water pipe 3 is filled with the blocking medium based on the determined or calculated blocking length. The length of the first blocking medium 5 and the second blocking medium 6 is determined according to the following method:

S1, building an environmental condition: applying 10 times the weight $m_{water}$ in the vertical direction of the water bag 1, and adjusting the environment temperature in which the water supply unit is located to the preset maximum temperature in the low gravity environment, where $m_{water}$ is the mass of water in the water bag 1;

S2, filling the air inlet pipe 2 and water pipe 3 with the blocking medium of a length 1, respectively, standing for 48 hours, and then proceeding to the next step; and S3, determining whether there is water squeezed out of the water bag 1, if there is water squeezed out of the water bag 1, returning to step S2; if there is not water squeezed out of the water bag 1, using the length of the medium after the blocking medium is gradually filled in the air inlet pipe 2 or water pipe 3 as the length of the blocking medium. For example, after repeating step S2 three times, the water in the water bag 1 will not be squeezed out, then the length of the blocking medium in the air inlet pipe 2 or water pipe 3 is l.

Through the above method for determining the length of the blocking medium, on the one hand, it is ensured that the water in the water bag 1 will not be squeezed out due to the increase in overweight water pressure during the launch stage from the earth's surface; on the other hand, it is ensured that in the low-gravity environment, the water in the water bag 1 will not be unable to pump out due to the large amount of the blocking medium that acts as a blocker in the water pipe.

Figure 4:
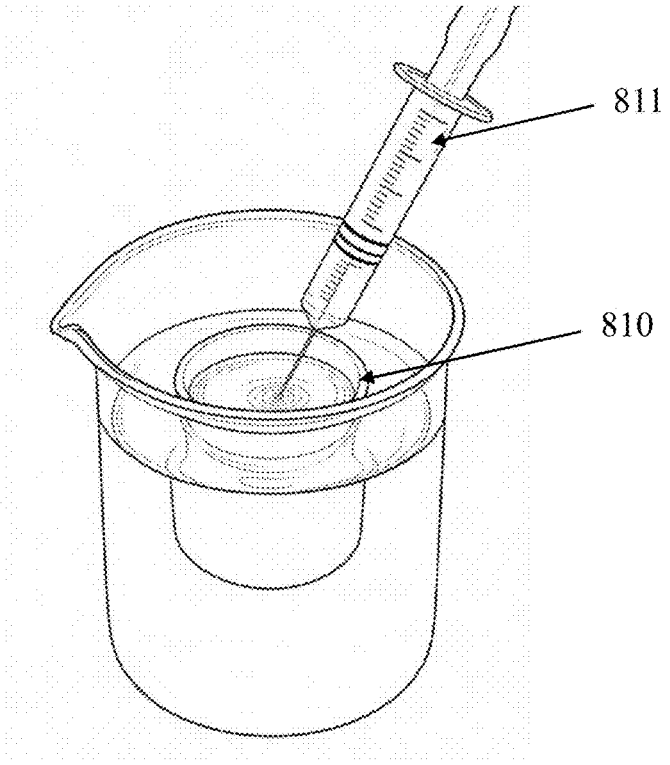
FIG. 4 is a schematic diagram of an application scenario of a water outlet and a container with high thermal conductivity according to the present application.

Referring to FIG. 4, the first blocking medium 5 or the second blocking medium 6 is filled according to the following method:

placing the blocking medium in a container 810 with good thermal conductivity, and placing the container on the hot water surface. After the blocking medium melts into a liquid state, using a syringe 811 to extract the liquid-state blocking medium and injecting it into the air inlet pipe 2 or water pipe 3, then letting it stand and waiting for the blocking medium to slowly cool down; the temperature of hot water is higher than the melting point of the blocking medium.

In this embodiment, both the first blocking medium 5 and the second blocking medium 6 are made of lipid-like chemicals. By using lipid-like chemicals, it is ensured that mold will not develop in high-temperature and high-humidity environments, thereby avoiding the possibility of infection with plant seeds or animal eggs and mold, and eliminating the impact on the growth and development of animals and plants. For example, Vaseline can be used as the lipid-like chemicals. Vaseline has been tested in engineering practice and can meet the above requirements with good results.

In this embodiment, the water pump 4 is provided on the water pipe 3 close to the water outlet 808, so that the water pumped by the water pump 4 can directly and effectively flush out the second blocking medium 6, ensuring the continuous and stable outflow of water.

In this embodiment, the water pump 4 is an electromagnetic water pump. By using the electromagnetic water pump, the working energy consumption is reduced, and the water in the water bag 1 can be drained completely.

In this embodiment, the water supply unit further includes a plastic slot 7 for fixing the water bag 1, a base for fixing the water pump 4, and tie wires surrounding the water pipe 3 at intervals in the horizontal direction. Through the above structure, it is ensured that the outlet angle of the water pipe 3 is adapted to the magnitude of gravity acceleration in the low gravity environment, which can prevent the upward tilt angle of the outlet end from being too large, the water flow from being too high or too far, and the water flow splashing onto equipment such as cameras or spraying into soil tanks, causing harm to the bottom electronic control board.

In this embodiment, the starting state of the water pump 4 is controlled according to the environmental information, so that the water in the water bag 1 flows out through the water pipe 3, which specifically includes:

a, determining whether the temperature is greater than or equal to a preset temperature and whether the illumination is greater than or equal to a preset illumination, if so, starting the water pump 4 and entering the next step; if not, not starting the water pump 4;

b, determining whether the water pressure on the outlet side of the water pump 4 is less than a preset pressure, if so, the water pump 4 will stop working, if not, the water pump 4 will continue to work and extract the water in the water bag 1 so that the water flows out from the outlet end of the water pipe 3. The preset temperature, preset illumination and preset pressure can be set according to the actual working conditions of the simulated low gravity environment.

Figure 2:
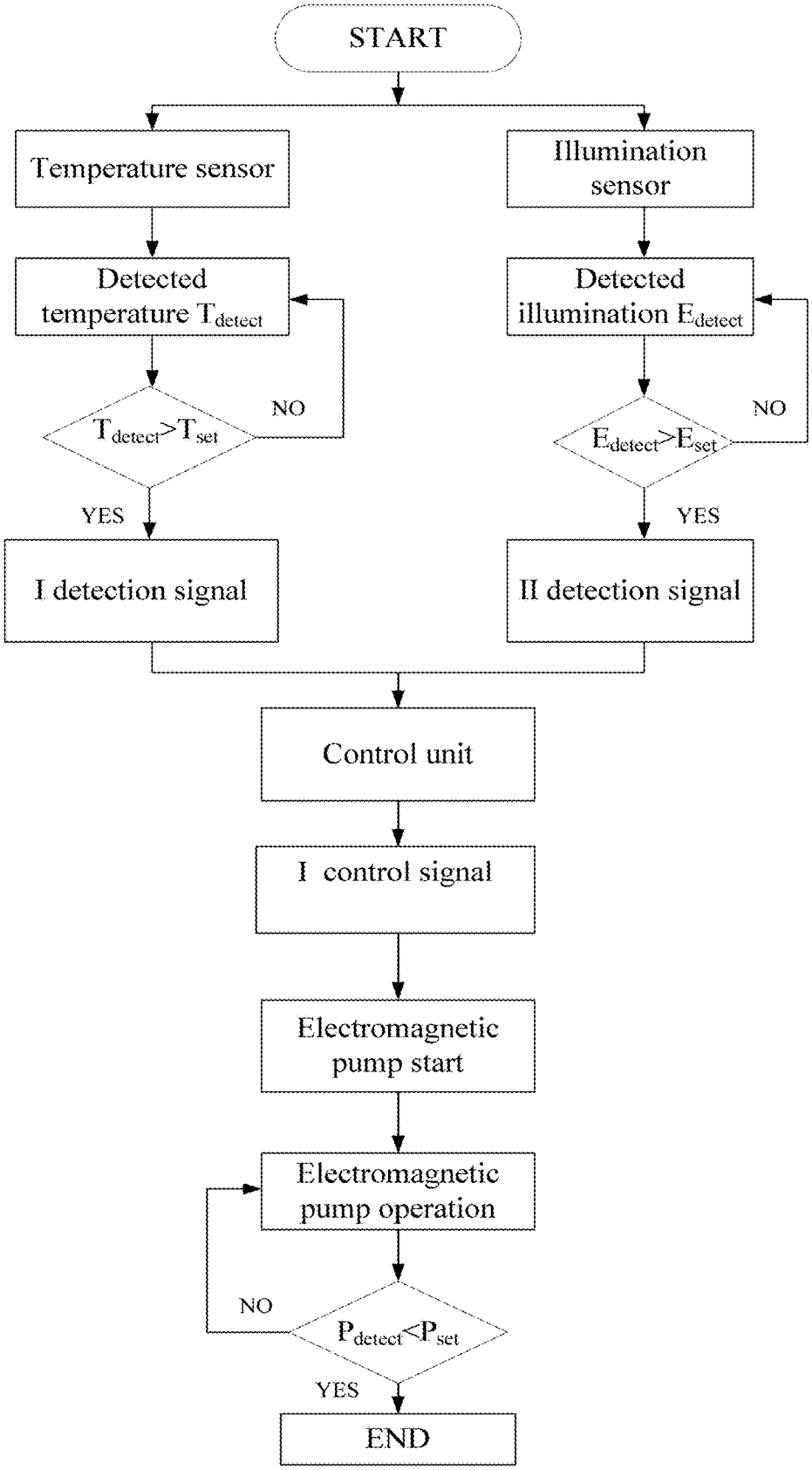
FIG. 2 is a schematic diagram of the working principle of the system according to the present application.
Figure 3:
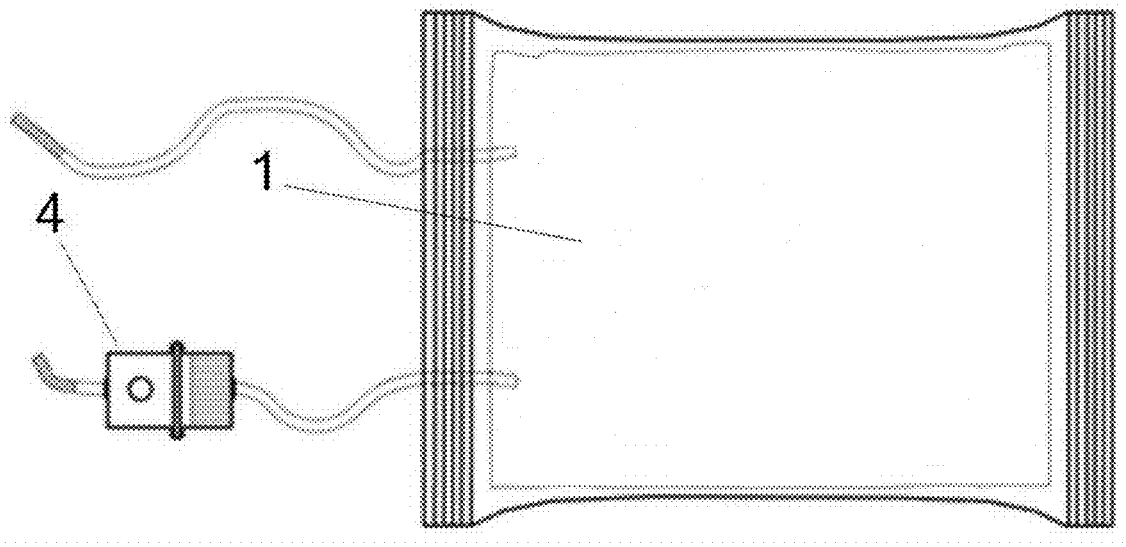
FIG. 3 is a schematic diagram of a connection structure between a water bag and a water pump according to the present application.

In order to better understand the water supply system of the present application, the working principle of the water supply system is specifically explained below with reference to FIG. 2.

According to the first detection signal sent by the temperature sensor and the second detection signal sent by the illumination sensor, it is determined that whether the temperature and illumination of the enclosed space to which the micro-ecosystem belongs have reached the corresponding thresholds. If both have reached or exceeded the corresponding thresholds, the electromagnetic water pump starts to start. That is, after the logic AND gate circuit of the control unit 803 receives the first detection signal and the second detection signal, it sends the first control signal to start the electromagnetic pump to start working and pump water from the water bag 1. The lipid-like chemicals (insoluble in water) in the air inlet pipe 2 are sucked into the water bag 1, and the lipid-like chemicals in the water pipe 3 are discharged from the water pipe 3. When the temperature is higher than or equal to the preset temperature, the lipid-like chemicals in the air inlet pipe 2 and water pipe 3 will also partially or completely melt.

During the operation of the water pump 4, if the detected water pressure signal on the outlet side of the electromagnetic water pump is lower than a preset threshold, the control unit 803 send the second control signal to the electromagnetic water pump, so that the electromagnetic water pump is controlled to stop running according to the second control signal, and the electromagnetic water pump stops running after completing the water delivery task. The water pressure on the outlet side of the electromagnetic water pump can be detected through the pressure sensor.

Finally, it should be noted that the above embodiments are only used to illustrate the technical solutions of the present application and are not limiting. Although the present application has been described in detail with reference to the preferred embodiments, those skilled in the art should understand that modifications or equivalent substitutions can be made for the technical solutions of the present application without departing from the spirit and scope of the present application, which should be included in the scope of the present application.

What is claimed is:

1. An automatic remote water supply system in a low gravity environment, comprising:

a water supply unit, comprising a water bag, an air inlet pipe, a water pipe and a water pump provided on the water pipe, wherein the water bag is provided with an air inlet and a water outlet at a bottom of the water bag, the air inlet pipe is communicated with the water bag through the air inlet, and the water pipe is communicated with the water bag through the water outlet;

an environmental detection unit, configured to detect environmental information in an ecological circle to which the water supply system belongs in the low gravity environment, wherein the environmental information comprises temperature and illumination; and a control unit, configured to control a starting state of the water pump according to the environmental information, so that water in the water bag flows out through the water pipe; wherein a first blocking medium is provided in a pipeline of the air inlet pipe, the first blocking medium is configured to separate an air inlet from an air outlet of the air inlet pipe, and the first blocking medium is driven to move inside the air inlet pipe through a negative pressure in the water bag created by a water extraction of the water pump; a second blocking medium is provided in a pipeline of the water pipe, the second blocking medium is configured to separate an inlet water from the water outlet of the water pipe, and the second blocking medium is driven to move inside the water pipe; and lengths of both the first blocking medium and the second blocking medium are configured as lengths of blocking mediums after the pipeline is stabilized for 48 hours and water is not discharged from the water bag.

2. The automatic remote water supply system in the low gravity environment of claim 1, wherein the first blocking medium or the second blocking medium is filled according to the following method:

placing the blocking medium in a container with good thermal conductivity and placing the container on a hot water surface; after the blocking medium is melted into a liquid state, using a syringe to extract a liquid blocking medium and injecting the liquid blocking medium into the air inlet pipe or water pipe; then letting the liquid blocking medium stabilize and wait for the blocking medium to slowly cool down, wherein a temperature of hot water is higher than a melting point of the blocking medium.

3. The automatic remote water supply system in the low-gravity environment of claim 1, wherein both the first blocking medium and the second blocking medium are made of lipid-like chemicals.

4. The automatic remote water supply system in the low gravity environment of claim 1, wherein the water pump is provided on the water pipe close to the water outlet.

5. The automatic remote water supply system in the low gravity environment of claim 1, wherein the water pump is an electromagnetic water pump.

6. The automatic remote water supply system in the low gravity environment of claim 1, wherein the environmental information comprises temperature and illumination, and the control unit is further configured to:

a, determine whether the temperature is greater than or equal to a preset temperature and whether the illumination is greater than or equal to a preset illumination, in response to that the temperature is greater than or equal to the preset temperature and the illumination is greater than or equal to the preset illumination, start the water pump and proceeding the next step, and in response to that the temperature is less than the preset temperature or the illumination is less than the preset illumination, not start the water pump; and b, determine whether a water pressure on an outlet side of the water pump is less than a preset pressure, in response to that the water pressure on the outlet side of the water pump is less than the preset pressure, the water pump is configured to stop working, and in response to that the water pressure on the outlet side of the water pump is greater than or equal to the preset pressure, the water pump is configured to work continuously and extract water in the water bag, so that the water flows out from the water outlet of the water pipe.

7. The automatic remote water supply system in the low gravity environment of claim 1, wherein the water supply unit further comprises a plastic slot for fixing the water bag, a base for fixing the water pump and tie lines spaced around the water pipe.

* * * * *